US006823596B1

(12) United States Patent
Roberts

(10) Patent No.: US 6,823,596 B1
(45) Date of Patent: Nov. 30, 2004

(54) TEMPLATE AND METHOD FOR TRISECTING AN ANGLE

(76) Inventor: Daniel William Roberts, 1055 Shawnmarr Rd., Unit #90, Mississauga (CA), L5H 3V2

( * ) Notice: Subject to any disclaimer, the term of this patent is extended or adjusted under 35 U.S.C. 154(b) by 0 days.

(21) Appl. No.: 10/665,354

(22) Filed: Sep. 22, 2003

(51) Int. Cl.[7] ..... B43L 11/00
(52) U.S. Cl. ..... 33/1 AP; 33/563
(58) Field of Search ..... 33/1 AP, 1 F, 562, 33/563, 565, 566

(56) References Cited

U.S. PATENT DOCUMENTS

| | | | | | |
|---|---|---|---|---|---|
| 1,109,479 | A | * | 9/1914 | Steed | 33/1 AP |
| 1,145,369 | A | * | 7/1915 | Kaplan | 33/1 AP |
| 1,181,388 | A | * | 5/1916 | Joiner | 33/1 AP |
| 1,222,525 | A | * | 4/1917 | Clarke | 33/1 AP |
| 1,764,581 | A | * | 6/1930 | Sibuya | 33/1 AP |
| 2,222,853 | A | * | 11/1940 | Neurohr | 33/1 AP |
| 2,450,167 | A | * | 9/1948 | Robinson | 33/1 AP |
| 2,547,745 | A | * | 4/1951 | Cade et al. | 33/1 F |
| 3,693,261 | A | * | 9/1972 | Moore | 33/1 AP |
| 4,490,916 | A | * | 1/1985 | Blum | 33/565 |
| 5,210,951 | A | * | 5/1993 | Chen | 33/1 AP |

FOREIGN PATENT DOCUMENTS

| | | | |
|---|---|---|---|
| DE | 1611808 | A1 * | 8/1969 |
| JP | 1308908 | A1 * | 12/1989 |

* cited by examiner

*Primary Examiner*—G. Bradley Bennett

(57) ABSTRACT

A transparent plastic template permits an angle to be conveniently truncated with a pencil and straight edge. The template has three holes equally spaced apart along a hypothetical line, a central hole and a pair of outer holes. A circle is centered about one of the outer holes, and has a radius equal to one-half the spacing between the outer holes. A line is defined on the template, perpendicular to the hypothetical line and intersecting the midpoint of the hypothetical line. The template is manually positioned on the angle with its line intersecting the vertex of the angle. Simultaneously, the circle is positioned so one arm of the angle forms a tangent, and the opposing outer hole is positioned on the other arm of the angle. The central hole and the hole surrounded by the circle are then positioned to mark a pair of trisecting lines through the vertex.

7 Claims, 6 Drawing Sheets

TEMPLATE AND METHOD FOR TRISECTING AN ANGLE

FIELD OF THE INVENTION

This invention relates to a devices and methods for trisecting an angle.

BACKGROUND OF THE INVENTION

Various devices have been proposed to enable trisecting of angle. Most are complex, comparatively expensive, difficult to use or suffer some significant shortcoming, as will be apparent from the prior art references below.

U.S. Pat. No. 1,145,369 to Kaplan describes a device that relies on a pair of external limiting members pivotally connected to each other with complex links. The mechanism is cumbersome and relatively expensive.

U.S. Pat. No. 1,764,581 to Shibuya describes angle trisector that uses a modified protractor. The device is potentially inexpensive to produce but the user must select proper graduations and perform calculations, making use complex.

U.S. Pat. No. 2,222,853 to Neurohr describes an angle trisector which uses a pair of side arms and a set of bars or arms pivotally connected to the side arms. The device is relatively expensive to produce and cumbersome to use or transport.

German disclosure No. 1611808, published on Feb. 13, 1968, describes a template for trisecting an angle. The template has a central horizontal line and five holes equally spaced along the line by a distance r. The center hole serves as the center of a circle of radius r. The periphery of the template is defined by two intersecting circles of radius 2r centered about the outermost holes. When the periphery is properly centered within angle, a pair of hypothetical lines through the vertex and tangential to the circle effectively trisect the angle. Although potentially inexpensive, a major shortcoming is that the two trisecting lines cannot be drawn or readily marked for drawing.

Russian Patent No. SU1735061-A1 to Memyrin describes a mechanism comprising cranks and slides linked to trisect an angle. The mechanism is complex, expensive and cumbersome.

U.S. Pat. No. 5,210,951 to Chen describes an instrument for trisecting an angle that has two circular planes and four pointers. Two pointers are intended to define either an acute or obtuse angle. Two other pointers are intended to divide the angle into three equal angles when oriented perpendicular to one other. The device is relatively expensive but awkward to use.

BRIEF SUMMARY OF THE INVENTION

In general, the invention provides a template that in effect identifies three congruent triangles between an angle to be trisected. The template relies on aligning and marking points (preferably defined by simple clearance holes) and a circular arc, all observing specific geometric relationships. This arrangement allows the template to be positioned to mark trisecting lines, effectively along certain sides of the hypothetical triangles. This operating principle need not be understood to use the template but will be described in greater detail below with reference to the drawings.

In one aspect, the invention provides a template for trisecting an angle displayed on a flat surface. The template comprises a first aligning point adapted for visual location over one arm of the angle, a second point where a marking hole is located, a line intended to be placed into intersecting relationship with the vertex of the angle, and a circular arc intended to be aligned in tangential relationship with the other arm of the angle. The line is perpendicular to a hypothetical line between the first and second points and aligned axially with the midpoint of the hypothetical line. The circular arc adapted for visual location in tangential relationship with the other arm. The circular arc is centered about the second point and has a radius equal to one half of the distance between the first and second points.

In one embodiment, the invention provides a transparent angle-trisecting template that comprises a pair of clearance holes, and a pair of circles of equal radius, each centered about a different clearance holes. The circles have a radius equal to one-half of the distance between the clearance holes, and consequently side-by-side forming a point contact. A central clearance hole is located at the midpoint of a hypothetical line between the pair of clearance holes, substantially at the point of contact between the two circles. A line extends perpendicular to the hypothetical line in aligned with the midpoint of the hypothetical line. This embodiment is symmetric and gives the user the option of using either circle to orient the template against one arm of the angle. The central clearance hole of the other circle can be located over the other arm. In this embodiment, the peripheral shape of the template is immaterial.

In another embodiment, the invention provides a template whose periphery is instrumental to trisecting an angle. The template comprises a pair of clearance holes, a lateral side edge perpendicular to a hypothetical line between the clearance holes and aligned with the midpoint of the line, and a projection that extends laterally relative to the side edge. The projection has a part-circular periphery centered about one of the clearance holes and has a radius equal to one-half the distance between the clearance holes. The template is positioned relative to an angle in substantially the same manner as discussed above. However, once oriented, the lateral side edge can be used to immediately draw one trisecting line. The other trisecting line is marked through the clearance hole centered in the part-circular periphery, and can be drawn with a straight edge extended through the vertex of the angle to the mark.

Other aspects of the invention will be apparent from a description below of preferred embodiments and will be more specifically defined in the appended claims.

BRIEF DESCRIPTION OF THE DRAWINGS

The invention will be better understood with respect to drawings in which.

PREFERRED EMBODIMENTS OF THE INVENTION

Figure 1:
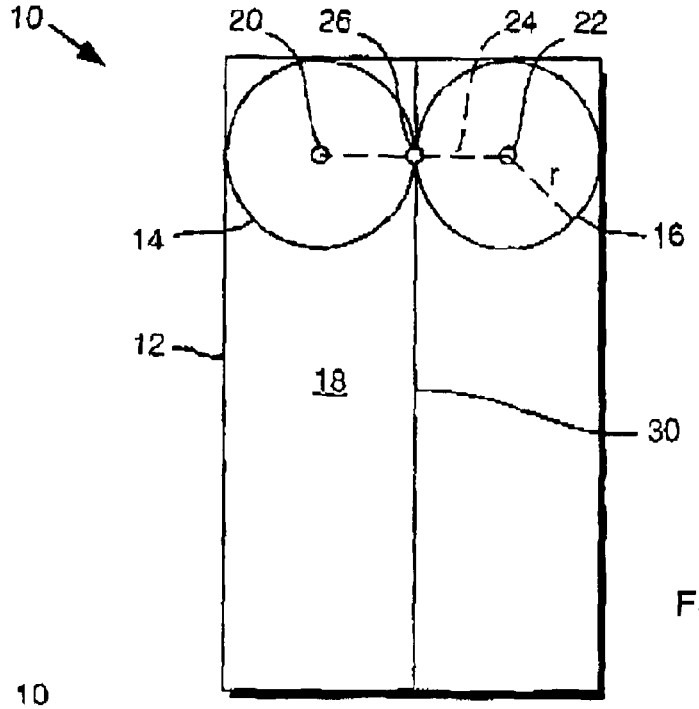
FIG. 1 is a plan view of a template for trisecting angles.

FIG. 1 shows a template 10, a flat member formed of transparent plastic. The template 10 has a rectangular periphery 12 and a thickness between one-sixteenth and one-eighth inches. The exact dimensions, shape and thickness of this template 10 are not critical. The template 10 need only be shaped to seat against a surface on which an angle has been drawn, such as a sheet of drawing paper.

Viewed in the orientation of FIG. 1, the template 10 comprises identical left and right circles 14, 16 with a common radius r. The circles 14, 16 may be defined on the upper face 18 of the template 10 by scoring or with conventional marking material. The left circle 14 is centered about a left marking hole 20 (effectively defining a left marking or sighting point), and the right circle 16, about another right marking hole 22 (defining a right marking or sighting point). In FIG. 1, a hypothetical line 24 has been shown in phantom outline, extending between the marking holes 20, 22. The holes 20, 22 are spaced apart by a distance equal to twice the radius r, and the circles 14, 16 are consequently side-by-side forming a point contact at the midpoint (not specifically indicated) of the hypothetical line 24. A central marking hole 26 is formed in the template 10 midway between the outer holes 20, 22, at the midpoint of the hypothetical line 24. A line 30 is formed on the upper face 18, perpendicular to the hypothetical line 24 and aligned with the midpoint of the hypothetical line 24.

Figure 2A:
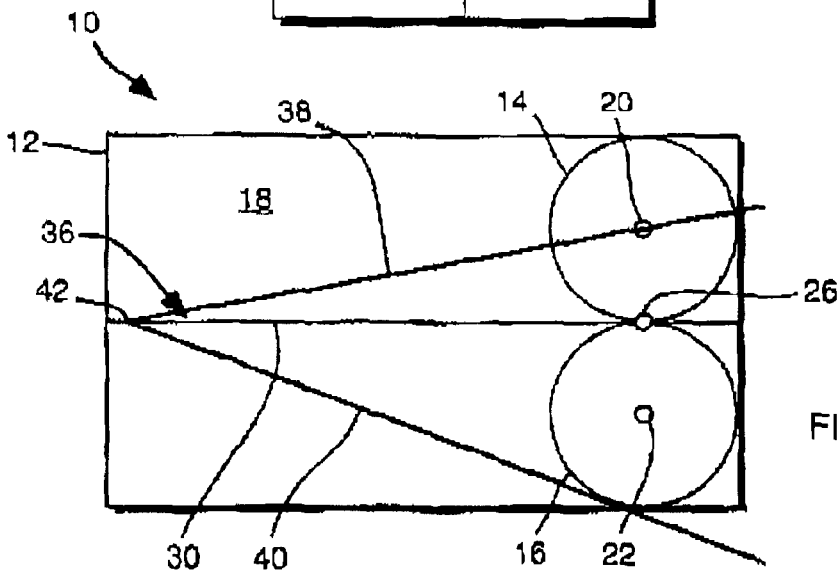
FIG. 2*a* shows how the template is positioned for marking the position of trisecting lines in an acute angle.
Figure 2B:
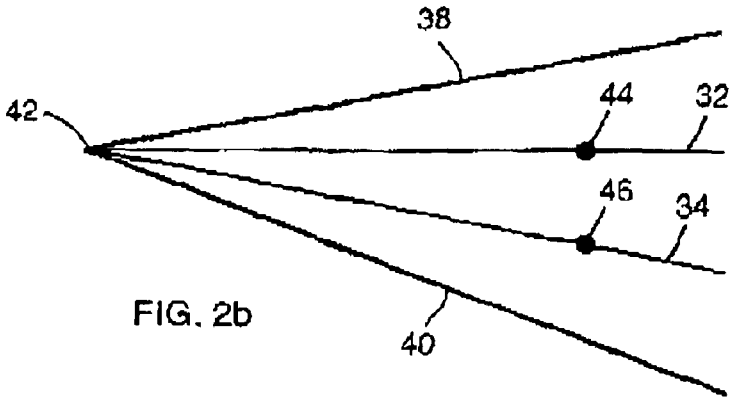
FIG. 2*b* shows how trisecting lines are drawn after marking.

FIGS. 2*a* and 2*b* shows how the template 10 can be used to mark trisecting lines 32, 34 on an acute angle 35. The angle 36 is defined by a pair of arms 38, 40 that intersect to define a vertex 42, and may have been drawn previously on a drawing sheet (not illustrated). The template 10 is displaced by hand until the following conditions are simultaneously met: the hole 20 is located over the angle arm 38; the circle 16 is located in tangential relationship with the angle arm 40; and the line 30 intersects the vertex 42 of the angle 36, all as shown in FIG. 2*a*. A pencil or other marking instrument may then be used to place marks 44, 46 on the drawing sheet through the central marking hole 26 and marking holes 22. These marks 44, 46 are shown as filled circles in FIG. 2*a*.

The template 10 is then removed, and trisecting lines 32, 34 as shown in FIG. 2*b* are drawn. Each of the trisecting lines 32, 34 is formed by aligning a ruler or other straight edge edge with the vertex 42 and one of the marks 44, 46. The general principle of operation inherent in the invention will be apparent in FIG. 2*b*. The geometry of the template 10 effectively identifies three triangles 48, 50, 52 between the angle arms 38, 40 of the angle 36, when the template 10 is positioned as required relative to the angle 36. Elementary geometry indicates that the three triangles 48, 50, 52 are congruent, and that their angles (not numbered) proximate to the vertex 42 are identical. The central marking hole 26 and the marking hole 22 are consequently oriented to fall on trisecting lines 32, 34. This template 10 is symmetric and consequently the hole 22 can be used as a sighting point to be positioned on the angle arm 40, and the hole 20 may then be used to mark a trisecting line.

Figure 2C:
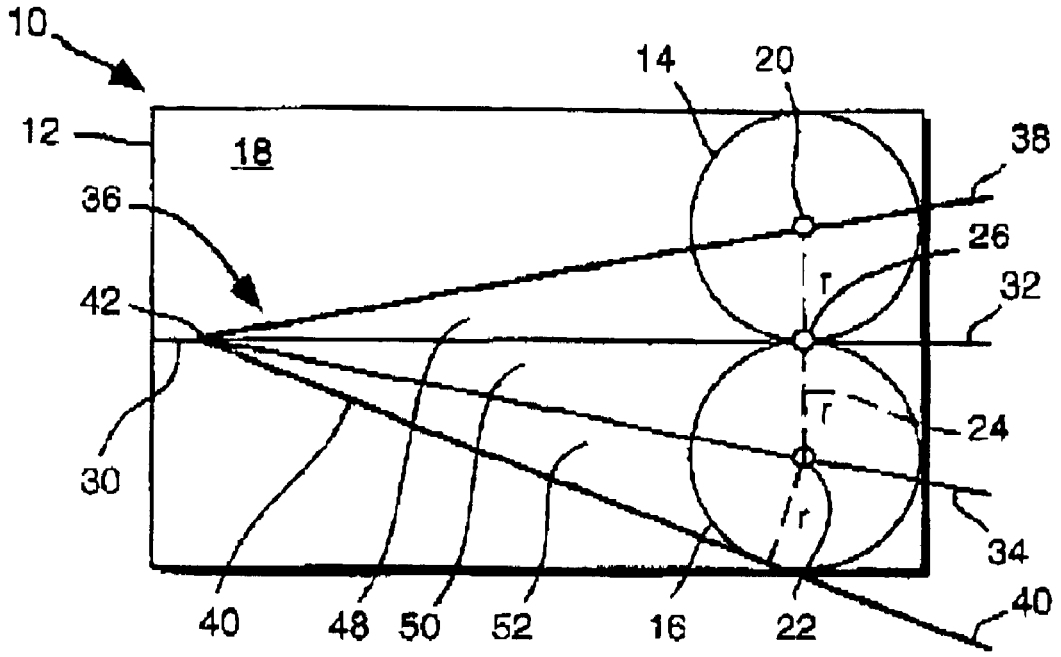
FIG. 2*c* illustrates the principles underlying the invention.
Figure 2D:
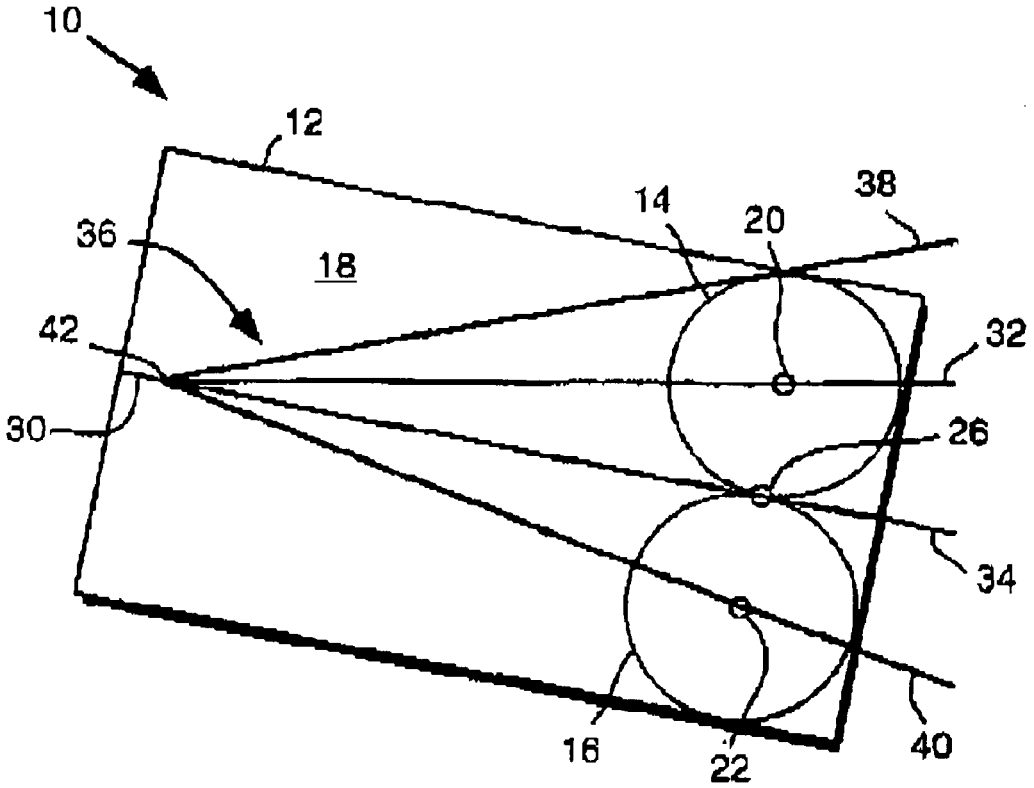
FIG. 2*d* illustrates how the trisecting lines can be verified with the template.
Figure 3:
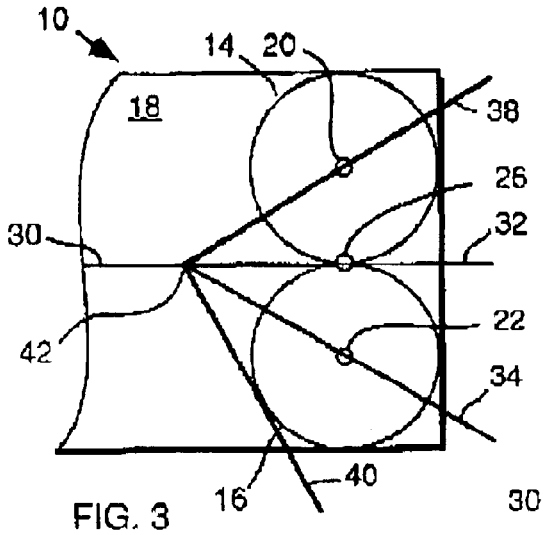
FIG. 3 shows how the template can be used to trisect a right angle.
Figure 4:
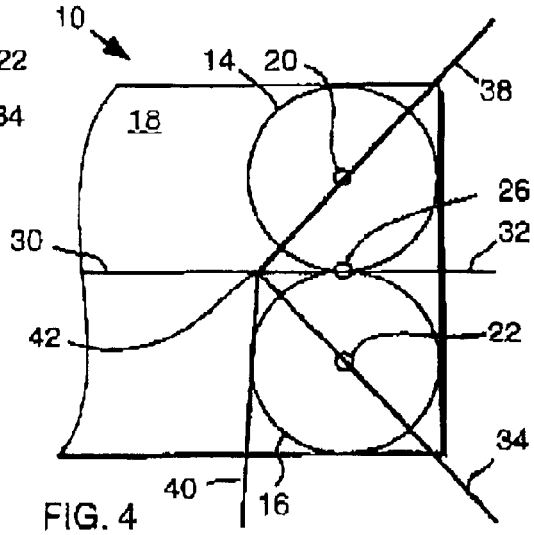
FIG. 4 shows how the template can be used to trisect an obtuse angle.
Figure 5:
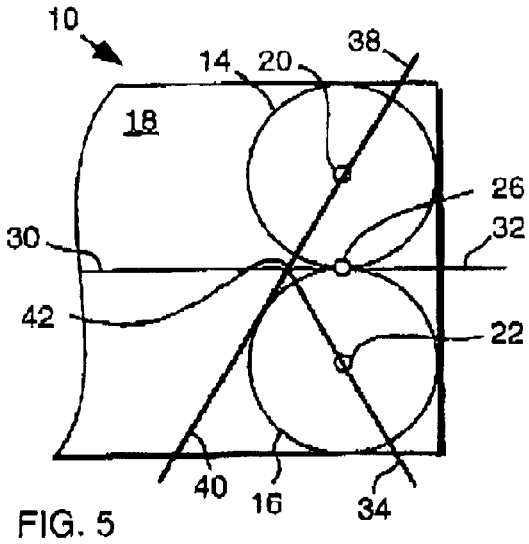
FIG. 5 shows how the template can be used to trisect a 180 degree angle.
Figure 6:
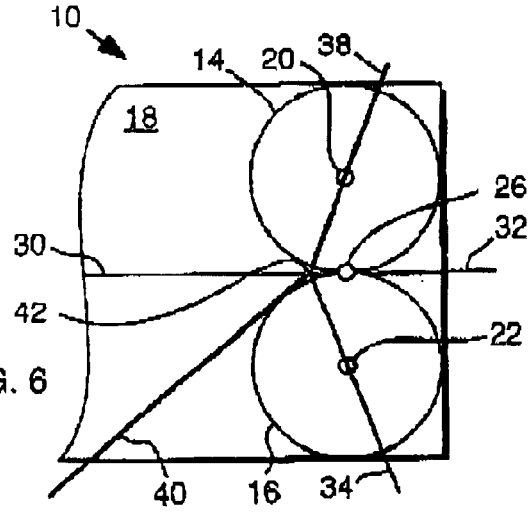
FIG. 6 shows how the template can be used to trisect a reflective angle.

FIG. 2*d* illustrates another aspect of the template 10, namely, detecting human error and verifying that trisecting lines 32, 34 do in fact trisect the angle 36. FIG. 2*d* shows the same angle 36 and the same trisecting lines 32, 34 produced in by the steps apparent in FIGS. 2*a*–2*c*. In this instance, the template 10 has been rotated so that the hole 22 can be overlayed with the lower angle arm 40 and the upper circle 14 can be placed in tangential relationship with the upper angle arm 38. This could serve as an alternative arrangement in which the trisecting lines are marked for drawing through upper hole 20 and the central hole 26. In this instance, the user simply sights through the upper hole 20 and the central hole 26 to confirm that the previously drawn lines 32, 34 pass through the holes 20, 32, confirming that they do trisect the angle 36.

The versatility of the trisecting template 10 will be more apparent from FIGS. 3–6 which illustrate how the template can be used respectively to trisect a angle, an obtuse angle, a 180 degree angle, and a reflective angle. Common reference numbers have been used to identify angle arms, vertices, and trisecting lines in FIGS. 3–6, the same reference numbers used in FIGS. 2*a*–*c*. The same general method for positioning the template 10 relative to a displayed angle, marking the drawing sheet to identify points on trisecting lines 32, 34, and actually drawing trisecting lines 32, 34, is used in each instance and may be understood with reference to the description of FIGS. 2*a* and 2*b*. The template 10 would normally be removed before drawing trisecting lines 32, 34, but has been illustrated together with the resulting trisecting lines 32, 34 as this arrangement better illustrates the geometric relationship between features on the template 10, the angle in issue, and the trisecting lines ultimately drawn.

Figure 7:
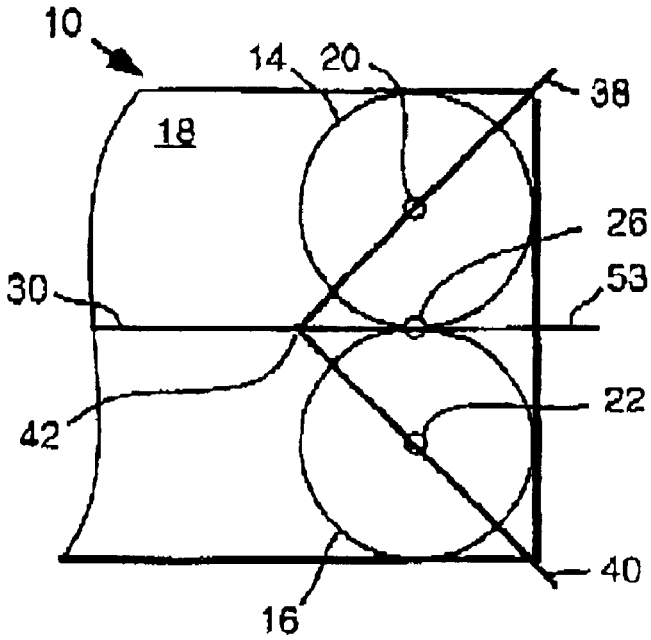
FIG. 7 shows how the template can be used to bisect an angle.

Reference is made to FIG. 7 which illustrates how the template 10 can also be used to bisect an angle 36. The template 10 is displaced relative to the angle 36 until each of the holes 20, 22 are located over the arms 38, 40 of the angle 36. The line 30 of the template is simultaneously positioned to intersect the vertex 42 of the angle 36. It will be recalled that the line 30 is perpendicular to the hypothetical line 84 (not shown in FIG. 7) extending between the centers of the pair of holes 20, 22, and essentially bisects the line 74, thus being equidistant from the holes 20, 22. Accordingly, when placed in the suggested orientation, the bisector 53 can be marked through the central hole 26, and then drawn through the mark and the vertex 42. The steps of marking and drawing the bisector 53 have been omitted to avoid needless reproduction of drawings, and the template 10 is effectively shown repositioned over the angle 36 and the bisecting line 53 after drawing.

Figure 8:
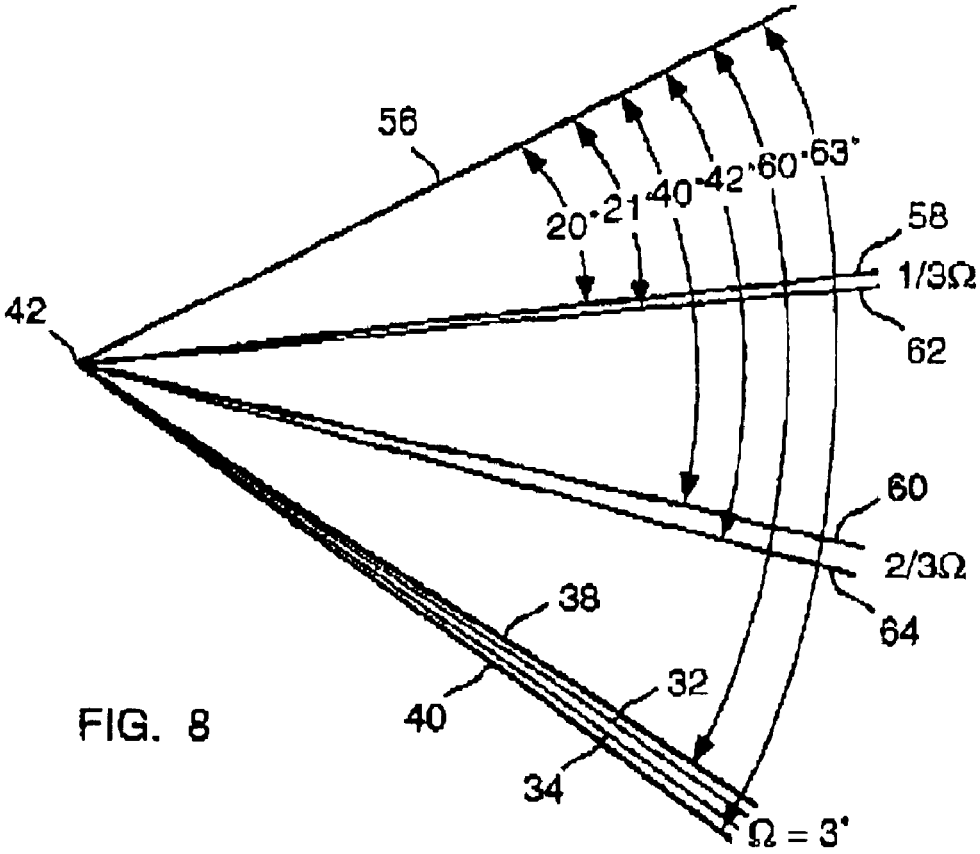
FIG. 8 shows a method of using the template to trisect a very small angle.

How the template 10 may be used to trisect a very small angle will explained with reference to FIG. 8. The angle requiring trisecting is identified as Ω in in FIG. 8, preferably formed on a transparency, and for purposes of exemplification may be 3 degrees. The object is not to apply the template 10 directly to the small angle Ω, which is not feasible, but to produce another transparency (assumed to be the plane of the drawing page) that can be used afterward to mark and draw trisecting lines 32, 34. A line 56 is drawn from the vertex 42 of angle Ω to define with the angle arm 40 a larger angle of 60 degrees (arbitrarily selected). The template 10 is then used to trisect the 60-degree angle to produce trisecting lines 58, 60. The template 10 is then used to trisect the larger combined 63-degree angle to produce trisecting lines 62, 64. As apparent from FIG. 8, the lines 58, 62 form an angle of one-third Ω or 1 degree, and the lines 60, 64 from an angle of two-thirds Ω or 2 degrees. The transparency so produced can be overlaid by the transparency bearing the angle Ω, and rotated to position the trisecting lines 58, 62 relative to the angle Ω into alignment with the upper angle arm 38 to mark or draw the trisecting line 32. The lines 60, 64 can then be rotated into alignment with the upper arm 38 to mark or draw the trisecting line 34. Since the working trisectors 58–64 represent one-third Ω and two-thirds Ω only a single pair is required to draw both trisectors 32, 34.

Several points should be noted regarding trisection of the angle Ω. First angle values have been indicated in FIG. 8 solely for exemplification. Second, since the trisector 10 does not rely on mathematical calculations or use of protractors, the value of Ω and the value of the large angle used to facilitate trisection of angle Ω are immaterial and need not be known.

Figure 9:
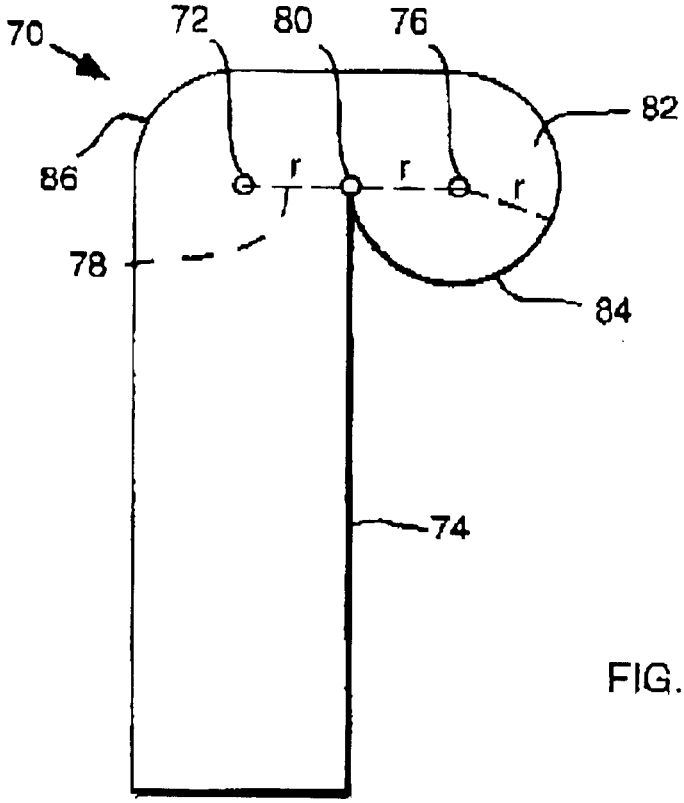
FIG. 9 is a plan view of an alternative template.

Reference is made to FIG. 9 which illustrates another template 70 for trisecting angles. The template 70 is a thin planar member formed of opaque plastic. In the orientation of FIG. 9, the template 70 is seen to comprise left and right circular holes 72, 74, the left hole 72 serving as a slightly hole and the right hole 74 as a marking hole. The template 70 has a lateral side edge 76 oriented perpendicular to a hypothetical line 78 between the left and right holes 72, 74 and aligned with the midpoint of the hypothetical line 78. The side edge 76 effectively defines a line corresponding in essence to the line 30 associated with the template 10 of FIG. 1, and performing the same function. A central marking hole 80 is located midway between the left and right holes 72, 74 at the midpoint of the hypothetical line 78. The template 70 has a projection 82 that extends laterally relative to the side edge 76 and has a part-circular periphery 84 (circular arc) centered about the right marking hole 74 and having a radius r equal to one-half the distance between the pair of outer holes 72, 74. One corner 86 of the template 70 defines a circular arc of radius r, largely for aesthetic reasons.

Figure 10:
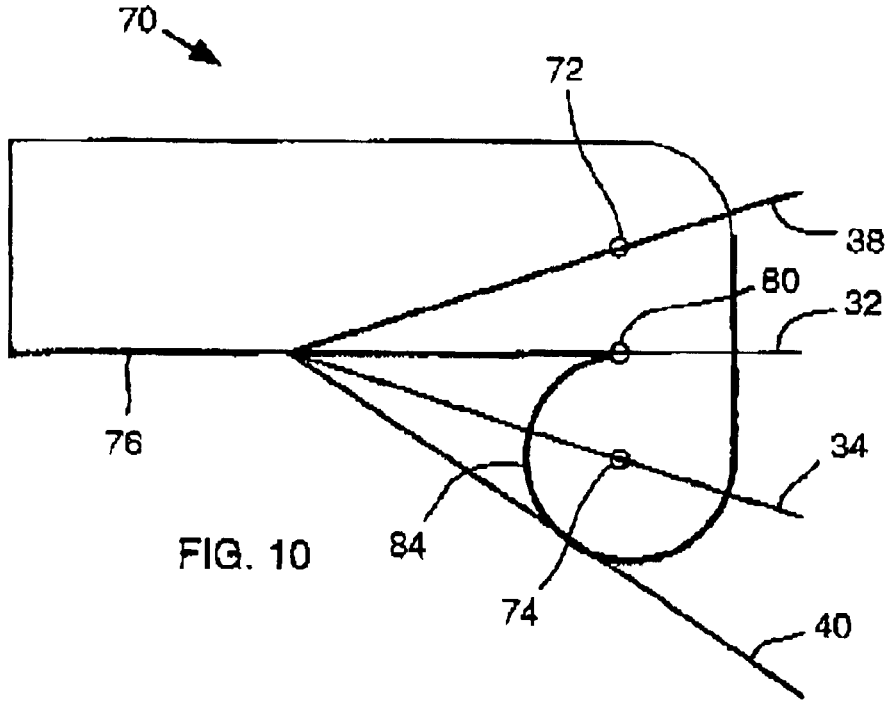
FIG. 10 shows how the template of FIG. 9 is positioned for marking of trisecting lines in an acute angle.

FIG. 10 shows how the template 70 is used to trisect an acute angle. Features associated with the angle and trisecting lines are labeled with reference numbers common to the angle shown in FIGS. 2*a*–2*b*. The user sights through the left holes 72 to position the left hole 72 over the left arm 38 of the angle, and simultaneously positions the lateral side edge 76 to intersect the vertex 42 of the angle, and the part-circular periphery 84 of the projection 82 in tangential relationship with the right arm 40. One trisecting line 32 can then be drawn immediately along the lateral side edge 76 or marked through the central hole 80 for drawing. The other trisecting line 32 is marked through the right marking hole 74, and then drawn with a straight line. This template 70 observes the same basic perhaps of operation described with respect to the template 10 of FIG. 1.

Figure 11:
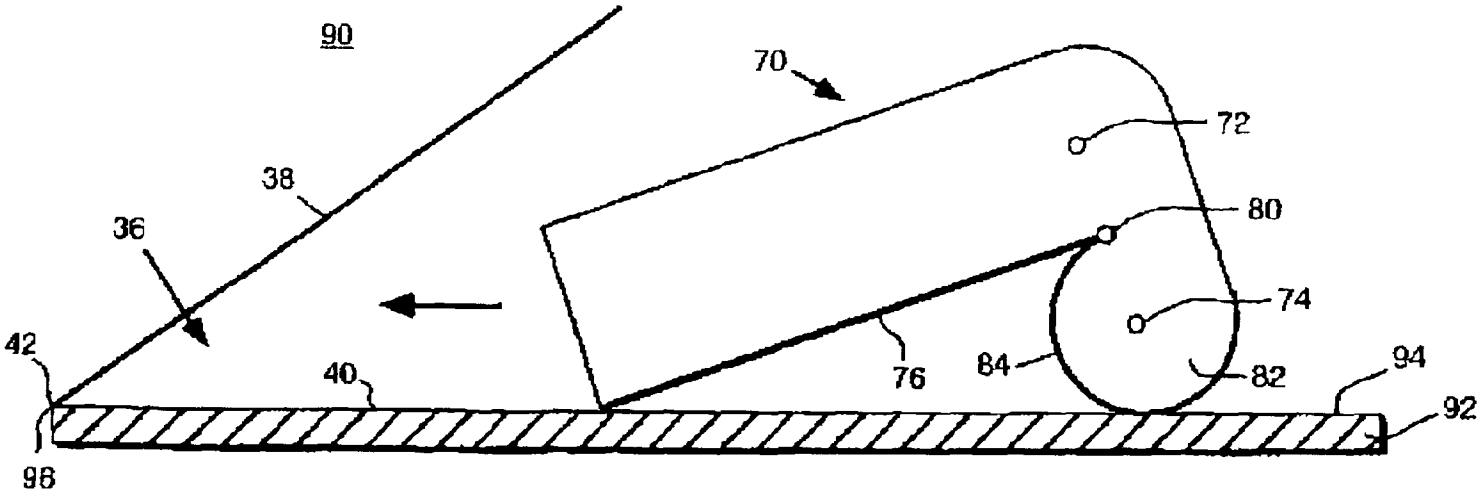
FIGS. 11 and 12 are elevational views showing how a particular application of the template, specifically trisecting an angle on a vertical surface adjacent a flat horizontal member that can support the template for sliding movement.
Figure 12:
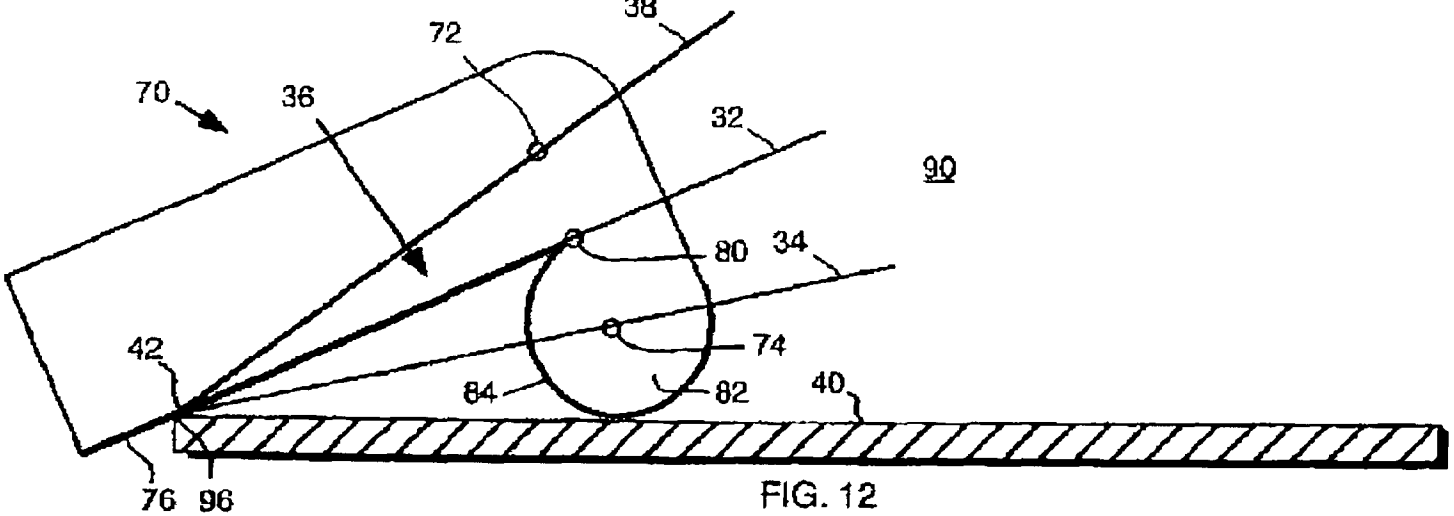

FIGS. 11 and 12 illustrate a particular application for the template 70. In that instance the angle 36 is drawn on a vertical wall surface 90. The object of trisecting the angle 36 is to delineate areas within the angle 36 that can be painted different colors. The wall surface 90 is located above a horizontal member 92 (in cross-section) with a flat upper horizontal surface 94. The vertex 42 associated with the angle 36 is positioned at a side edge 96 of the member 92, and the arm 40 of the angle 36 is substantially coincident with the upper surface 94. The template 70 is oriented flat against the wall surface 90 with the circular periphery seated against the upper horizontal surface 94, and the end of the side edge 76 distant from the projection 82 contacting the surface 94. The user slides the template 70 along the upper surface 94 in the direction of the arrow of FIG. 11 until the sighting hole 72 aligns with the now upper angle arm 38 as shown in FIG. 12. The arrangement is particularly simple because the user is obliged only to ensure that the sighting hole 72 aligns with the angle arm 38. More specifically, the circular periphery 84 remains continually in tangential relationship with the upper arm 40 and the lateral side edge 76 intersects the angle's vertex 42 automatically upon reaching the side edge 96 of the horizontal member 92.

It will be appreciated that particular embodiments of the invention have been illustrated and described, and that changes may be made thereto without departing from the scope of the appended claims.

I claim:

1. A template for trisecting an angle defined between a pair of straight arms that intersect at a vertex, the template comprising:

means defining on the template a first point adapted for visual location over one of the arms;

a second point surrounded by a marking hole;

a trisector line adapted for visual location in intersecting relationship with the vertex, the trisector line oriented perpendicular to a hypothetical line between the first and second points and aligned axially with the midpoint of the hypothetical line; and, a circular arc adapted for visual location in tangential relationship with the other arm, the circular arc centered about the second point and having a radius equal to one half of the distance between the first and second points.

2. The template of claim 1 in which the template comprises:

a marking hole surrounding the first point;

a marking hole at the midpoint of the hypothetical line.

3. The template of claim 1 comprising:

a lateral side edge defining the trisector line;

a projection extending laterally outward relative to the side edge and defining the circular arc.

4. The template of claim 3 in which the template comprises:

a marking hole surrounding the first point;

a marking hole at the midpoint of the hypothetical line.

5. A transparent template for trisecting an angle, the template comprising:

a pair of circles of equal radius;

a pair of clearance holes, each of the clearance holes located at the center of a different one of the circles, the pair of clearance holes spaced by a distance equal to twice the radius of the circles whereby the circles are side by side;

a central clearance hole located at the midpoint of a hypothetical line between the pair of clearance holes;

a line oriented perpendicular to the hypothetical line and aligned with the midpoint of the hypothetical line.

6. A generally planar template for trisecting an angle, the template comprising:

a pair of clearance holes;

a lateral side edge oriented perpendicular to a hypothetical line between the clearance holes and aligned with the midpoint of the hypothetical line; and, a projection extending laterally relative to the side edge, the projection comprising a part-circular periphery centered about one of the clearance holes and holes a radius equal to one-half the distance between the pair of clearance holes.

7. The template of claim 6 further comprising a central clearance hole located at the midpoint of the hypothetical line.

* * * * *